US008564218B2

(12) United States Patent
Radermacher et al.

(10) Patent No.: US 8,564,218 B2
(45) Date of Patent: Oct. 22, 2013

(54) DRIVING A LIGHT-EMITTING DIODE

(75) Inventors: Harald Josef Gunther Radermacher, Aachen (DE); Georg Sauerlaender, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 251 days.

(21) Appl. No.: 12/919,041

(22) PCT Filed: Mar. 2, 2009

(86) PCT No.: PCT/IB2009/050820
§ 371 (c)(1),
(2), (4) Date: Aug. 24, 2010

(87) PCT Pub. No.: WO2009/109888
PCT Pub. Date: Sep. 11, 2009

(65) Prior Publication Data

US 2010/0320931 A1 Dec. 23, 2010

(30) Foreign Application Priority Data

Mar. 5, 2008 (EP) ..... 08102309

(51) Int. Cl.
*H05B 37/02* (2006.01)

(52) U.S. Cl.
USPC ..... 315/291; 315/224; 315/360

(58) Field of Classification Search
USPC ..... 315/291, 307, 223, 224, 254, 258, 276, 315/294, 299, 360
See application file for complete search history.

(56) References Cited

U.S. PATENT DOCUMENTS

| | | | | | |
|---|---|---|---|---|---|
| 2,928,999 | A | * | 3/1960 | Vinding | 361/152 |
| 4,369,490 | A | * | 1/1983 | Blum | 363/48 |
| 4,795,959 | A | * | 1/1989 | Cooper | 323/308 |
| 4,930,061 | A | * | 5/1990 | Slack et al. | 363/44 |
| 4,961,044 | A | * | 10/1990 | Kravitz | 323/205 |
| 5,148,360 | A | | 9/1992 | Nguyen | |
| 5,189,357 | A | * | 2/1993 | Woodson et al. | 318/737 |
| 5,224,029 | A | | 6/1993 | Newman, Jr. | |

(Continued)

FOREIGN PATENT DOCUMENTS

WO 9612338 A2 4/1996

OTHER PUBLICATIONS

W. E. Johns, "Notes on LEDs", 2003, http://www.gizmology.net/LEDs.htm (PDF Included).*

(Continued)

*Primary Examiner* — Tung X Le
(74) *Attorney, Agent, or Firm* — Mark Beloborodov; Yulia Mathis

(57) ABSTRACT

An input stage (10) of an apparatus (1) for driving a light-emitting diode (40-42) receives a signal from a power supply (30-32), and an output stage (20) supplies a current to the light-emitting diode (40-42). The peak value divided by the average value of the current forms a ratio. The driving efficiency is improved by providing the input stage (10) with an arrangement (11) for reducing this ratio by manipulation of the signal, without the necessity of using any smoothing capacitors/inductors. The manipulation may comprise an addition of a frequency component to the signal or an adaptation of an amplitude of a frequency component of the signal. This frequency component may be a third and/or fifth and/or seventh harmonic frequency component of a fundamental frequency component of the signal. The arrangement (11) may comprise a resonant tank which may need to be tuned to the frequency component of the signal.

20 Claims, 3 Drawing Sheets

(56) References Cited

U.S. PATENT DOCUMENTS

| | | | | |
|---|---|---|---|---|
| 5,251,120 | A | 10/1993 | Smith | |
| 5,283,502 | A | 2/1994 | Piasuowski et al. | |
| 5,424,680 | A | 6/1995 | Nazarathy et al. | |
| 5,532,917 | A | 7/1996 | Hung | |
| 7,573,729 | B2 * | 8/2009 | Elferich et al. | 363/21.02 |
| 7,586,486 | B2 * | 9/2009 | Sasaki et al. | 345/204 |
| 7,772,782 | B2 * | 8/2010 | Chu et al. | 315/247 |
| 8,102,216 | B1 * | 1/2012 | Kaczynski | 331/117 FE |
| 2002/0186026 | A1 * | 12/2002 | Elferich | 324/652 |
| 2006/0022905 | A1 | 2/2006 | Sasaki et al. | |

OTHER PUBLICATIONS

Yanchao et al: "An Improved Passive Input Current Waveshaping Method for Single-Phase Diode Rectifier"; Proceedings of the 1996 IEEE IECON 22nd International Confrerence on Industrial Electronics, Control and Instrumentation, vol. 2, Aug. 1996, pp. 695-699.

Prasad et al: "A Novel Passive Waveshaping Method for Single-Phase Diode Rectifiers"; IEEE Transactions on Industrial Electronics, Dec. 1990, vol. 37, No. 6, pp. 521-530.

Gottlieb, I.: "Improving Power-Factor"; Electronics World, Jul./Aug. 1996, vol. 102, No. 1724, pp. 586-587.

Ignazio, B.: "High Power Factor Resonant Rectifier for UPS Systems"; Proceedings of the Annual Applied Power Electronics Conference and Exhibition, (APEC), Boston, MA, Feb. 1992, vol. Conf. 7, pp. 594-597.

Abuelma'Atti, M.: "Harmonic and Intermodulation Performance of Double-Heterostructure LEDs"; Journal of Lightwave Technology, vol. LT-2, No. 4, Aug. 1984, pp. 531-536.

Asatani et al: "Linearization of LED Nonlinearity by Predistortions"; IEEE Journal of Solid-State Circuits, vol. SC-13, No. 1, Feb. 1978, pp. 133-138.

* cited by examiner

DRIVING A LIGHT-EMITTING DIODE

FIELD OF THE INVENTION

The invention relates to an apparatus for driving a light-emitting diode, to a device comprising the apparatus, and to a method of driving a light-emitting diode.

Examples of such an apparatus are light-emitting diode drivers, and examples of such a device are consumer products and professional products.

BACKGROUND OF THE INVENTION

U.S. Pat. No. 5,424,680 discloses a generalized frequency-dependent pre-distortion circuit for non-linear optical devices such as semiconductor lasers and light-emitting diodes. The circuit comprises pre-filters and post-filters, each filter being an integral equalizing filter which arbitrarily manipulates phase and amplitude in a frequency-dependent fashion. Each filter is a synthesized filter tuned or built according to a specific complex frequency-dependent profile for giving a non-linear optical device a more linear behavior.

OBJECT AND SUMMARY OF THE INVENTION

It is an object of the invention to provide an apparatus for driving a light-emitting diode with improved efficiency.

Further objects of the invention are to provide a device comprising the apparatus, and a method of driving a light-emitting diode with improved efficiency.

In accordance with a first aspect, an apparatus is provided for driving a light-emitting diode, the apparatus comprising:

an output stage for supplying a current to the light-emitting diode, the current having an average value and a peak value, the peak value divided by the average value forming a ratio, and an input stage for receiving a signal from a power supply, the input stage comprising an arrangement for reducing the ratio by manipulation of the signal.

An output stage of the apparatus supplies a current to the light-emitting diode. This current has an average value and a peak value. The peak value divided by the average value is defined to be a ratio. An input stage of the apparatus receives a signal from a power supply. This input stage comprises an arrangement for reducing the ratio through manipulation of the signal. In other words, the arrangement reduces the ratio by manipulating the signal. A reduction of the ratio is realized, for example, by a reduction of the peak value while keeping the average value substantially constant. In other words, the ratio is reduced, for example, by reducing the peak value while keeping the average value substantially constant. As a result, the light-emitting diode generates more light for the same average current as compared to driving the light-emitting diode directly from the power supply without the input stage being used (due to the droop effect of current light-emitting diodes). In this way, the light-emitting diode is driven with improved efficiency, for example, as compared to driving it with a basically sinusoidal current (e.g. from a resonant power converter) or a basically sinusoidal voltage (e.g. when driving the light-emitting diode from the mains, using a resistive ballast).

Instead of driving one light-emitting diode, the apparatus may drive two or more light-emitting diodes. These two or more light-emitting diodes may be serial light-emitting diodes, parallel light-emitting diodes, or light-emitting diodes in a partly serial and partly parallel connection. A light-emitting diode may be, for example, an inorganic light-emitting diode, an organic light-emitting diode or a light-emitting laser diode, without the exclusion of further light-emitting diodes.

Instead of using the ratio defined by the peak value divided by the average value, or in addition to this ratio, another ratio may be used, which is defined by the root mean square value divided by the average value of the current supplied by the output stage.

The arrangement may comprise one or more sub-arrangements. One or more further arrangements, each possibly comprising one or more sub-arrangements, are not to be excluded.

In one embodiment of the apparatus, the stages comprise no smoothing capacitors and no smoothing inductors. A smoothing capacitor (inductor) or a DC storage capacitor (inductor) may be used in other solutions for reducing the ratio. Such a capacitor (inductor) must handle relatively much energy, which requires a relatively large component value and limits the selection of usable components to expensive or bulky or heavy or lifetime-limited components. An example is the use of an electrolytic capacitor as a smoothing capacitor for storing energy in a rectified part (DC-part) of a circuit. Such capacitors (inductors) are preferably not to be used in, for example, the output stage, for reducing the ratio defined by the peak value divided by the average value, owing to the fact that they introduce lifetime and reliability issues and/or that they increase the volume, size and costs of the apparatus. In addition, when using smoothing units, high-frequency dimming performance (by enabling and disabling the power supply in a fast sequence) of the light-emitting diodes is affected. Without DC storage units coupled to the light-emitting diode, its current and hence its brightness can react rapidly to the supplied energy. This allows fast and accurate dimming. With large DC storage units coupled to the light-emitting diode, there is a slow rise and decay of the light-emitting diode current, resulting in a poorer dimming performance.

A smoothing capacitor (inductor) is herein defined to be a capacitor (inductor) which reduces said ratio, for example, by at least 1% or, for example, by at least 5% or, for example, by at least 10%, without the exclusion of other percentages.

In accordance with an embodiment of the apparatus, the manipulation comprises an addition of a frequency component to the signal or an adaptation of an amplitude of a frequency component of the signal. The signal can be easily manipulated by adding one or more frequency components to the signal or adapting an amplitude of one or more frequency components already present in the signal. The phase or phases of the one or more frequency components to be added may be adjusted to a phase of a fundamental frequency component of the signal, such that the ratio of the resulting signal is reduced.

In accordance with a further embodiment of the apparatus, the frequency component of the signal comprises a third and/or fifth and/or seventh harmonic frequency component of a fundamental frequency component of the signal. A fundamental frequency component may be, for example, 50 Hz (mains in Europe) or 60 Hz (mains in the USA) or 10 kHz or 100 kHz or 1 MHz (converter), respectively, in which case the third (fifth, seventh) harmonic frequency components will be 150 (250, 350) Hz or 180 (300, 420) Hz or 30 (50, 70) kHz or 300 (500, 700) kHz or 3 (5, 7) MHz, respectively. Again, the phase or phases of the one or more frequency components may be adjusted to a phase of the fundamental frequency component of the signal. A phase angle of 0° may be advantageous for, for example, the third harmonic frequency component.

In accordance with another embodiment of the apparatus, an amplitude of the third and/or fifth and/or seventh frequency component of the signal divided by an amplitude of the fundamental frequency component of the signal forms a further ratio which is larger than 0% and smaller than 100%. The further ratio is preferably larger than 5% and smaller than 50%, more preferably between 10% and 40%.

In accordance with an embodiment of the apparatus, the signal is an alternating voltage. Such an alternating voltage is to be converted into an output current via the input stage and the output stage.

In accordance with an embodiment of the apparatus, the arrangement comprises a resonant tank. Such a resonant tank may be a controlled or non-controlled tank and may need to be tuned to the frequency component of the signal such as the third or fifth or seventh harmonic frequency component of the fundamental frequency component of the signal.

In accordance with yet another embodiment of the apparatus, the output stage comprises connection circuitry and/or transformer circuitry and/or rectifier circuitry. Such connection circuitry may comprise one or more wires, while the transformer circuitry may comprise one or more coils and/or one or more transformers, and the rectifier circuitry may comprise one or more diodes or one or more transistors.

In accordance with a further embodiment of the apparatus, the arrangement comprises a resonant tank which uses reactive properties of the connection circuitry and/or transformer circuitry and/or rectifier circuitry.

An embodiment of the apparatus further comprises:

a connector for connecting the input stage to a power source of the power supply.

Such a connector may be used, for example, for connecting the input stage to a mains supply. In that case, the signal is, for example, a sine signal, and a frequency component must be added to the signal.

Another embodiment of the apparatus further comprises:

a converter to be coupled to a power source of the power supply for generating the signal. Such a converter may get its power from a mains supply or from some kind of battery. In that case, the signal may be an alternating block signal, and an amplitude of a frequency component of the signal must be adapted.

In a further embodiment of the apparatus, the converter is a resonant mode converter, and one or more phase angles of one or more frequency components of the signal are arranged to keep the converter in a resonant mode.

In accordance with a second aspect, a device is provided, which comprises the apparatus as defined above and further comprises the light-emitting diode coupled to the output stage.

In accordance with a third aspect, a method of driving a light-emitting diode is provided, the method comprising:

at an output stage, a step of supplying a current to the light-emitting diode, the current having an average value and a peak value, the peak value divided by the average value forming a ratio, and at an input stage, a step of receiving a signal from a power supply, and a step of manipulating the signal for reducing the ratio.

Embodiments of the device and the method correspond to the embodiments of the apparatus.

The invention is based on the recognition that a light-emitting diode is a non-linear element which, for a doubled input (double input current), does not show a doubled output (no double output amount of light). It is also based on the recognition that a ratio defined by a peak value divided by an average value of a current (at an output stage) is to be reduced (at an input stage) by manipulation of a signal originating from a power supply.

This solves the problem of providing an apparatus for driving a light-emitting diode with improved efficiency. It has the advantage that the efficiency of the light-emitting diode as well as that of one or more other parts of the input stage and/or the output stage is improved.

These and other aspects of the invention are apparent from and will be elucidated with reference to the embodiment(s) described hereinafter.

DESCRIPTION OF EMBODIMENTS

Figure 1:
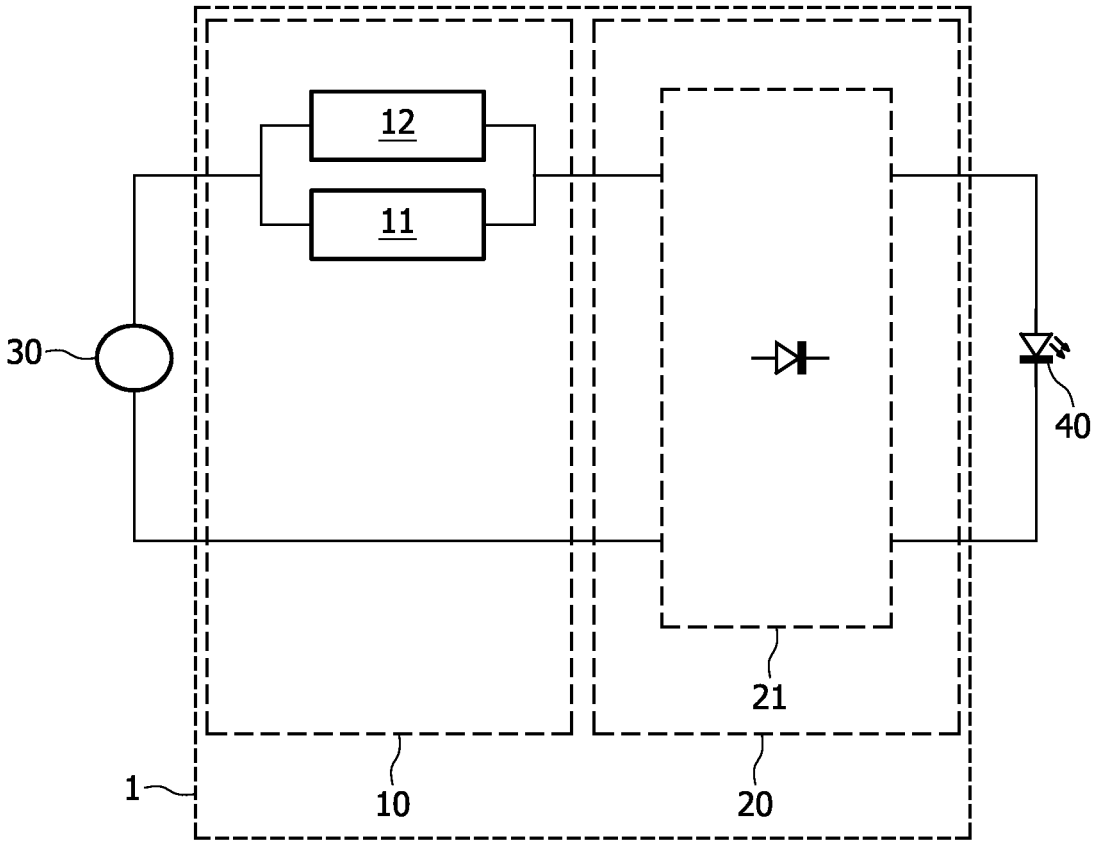
FIG. 1 shows a first embodiment of an apparatus.

FIG. 1 shows a first embodiment of an apparatus 1 comprising an input stage 10 and an output stage 20. The input stage 10 comprises a parallel circuit of an arrangement 11 and a further arrangement 12. One side of this parallel circuit is coupled to a first terminal of a power source 30 such as a 50 Hz power supply, and the other side of this parallel circuit is coupled to a first input of rectifier circuitry 21 of the output stage 20. A second input of the rectifier circuitry 21 is coupled to a second terminal of the power source 30. A first output of the rectifier circuitry 21 is coupled to an anode of a light-emitting diode 40, and a second output of the rectifier circuitry 21 is coupled to a cathode of the light-emitting diode 40. The rectifier circuitry 21 comprises, for example, four diodes in a rectifier bridge.

Figure 2:
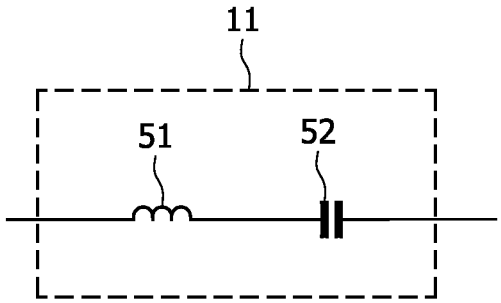
FIG. 2 shows an embodiment of an arrangement.

FIG. 2 shows an embodiment of an arrangement 11 comprising a resonant tank in the form of a serial circuit of an inductor 51 and a capacitor 52. Arrangements, resonant tanks and circuits other than the serial circuit such as at least partly parallel circuits are not to be excluded.

The apparatus 1 shown in FIG. 1 drives the light-emitting diode 40. The output stage 20 supplies a current to the light-emitting diode 40. This current has an average value and a peak value. The peak value divided by the average value forms a ratio. The input stage 10 receives a signal from the power source 30, such as an alternating voltage or AC voltage, such as a 50 Hz voltage signal. The arrangement 11 reduces the ratio by manipulation of the signal.

The manipulation comprises, for example, an addition of a frequency component to the signal or, for example, an adaptation of an amplitude of a frequency component of the signal. This frequency component of the signal comprises, for example, a third or fifth or seventh harmonic frequency component of a fundamental frequency component of the signal. For an alternating voltage such as a 50 Hz voltage signal, the fundamental frequency component is thus a 50 Hz component, and the third or fifth or seventh harmonic frequency component is a 150 Hz or 250 Hz or 350 Hz component. The amplitude of the third or fifth or seventh frequency component of the signal divided by an amplitude of the fundamental frequency component of the signal forms a further ratio. This further ratio is, for example, larger than 0% and smaller than 100%, preferably between 5% and 50%, more preferably between 10% and 40%.

If the power source 30 is a source for supplying a 50 Hz voltage signal with a sine shape, the resonant tank of the arrangement 11 is to be tuned to the third (150 Hz) or fifth (250 Hz) or seventh (350 Hz) harmonic frequency component of this 50 Hz voltage signal. In this case, the further arrangement 12 may comprise, for example, a resistor. The further ratio will depend on the dimensions of the components of the arrangements 11 and 12.

Figure 3:
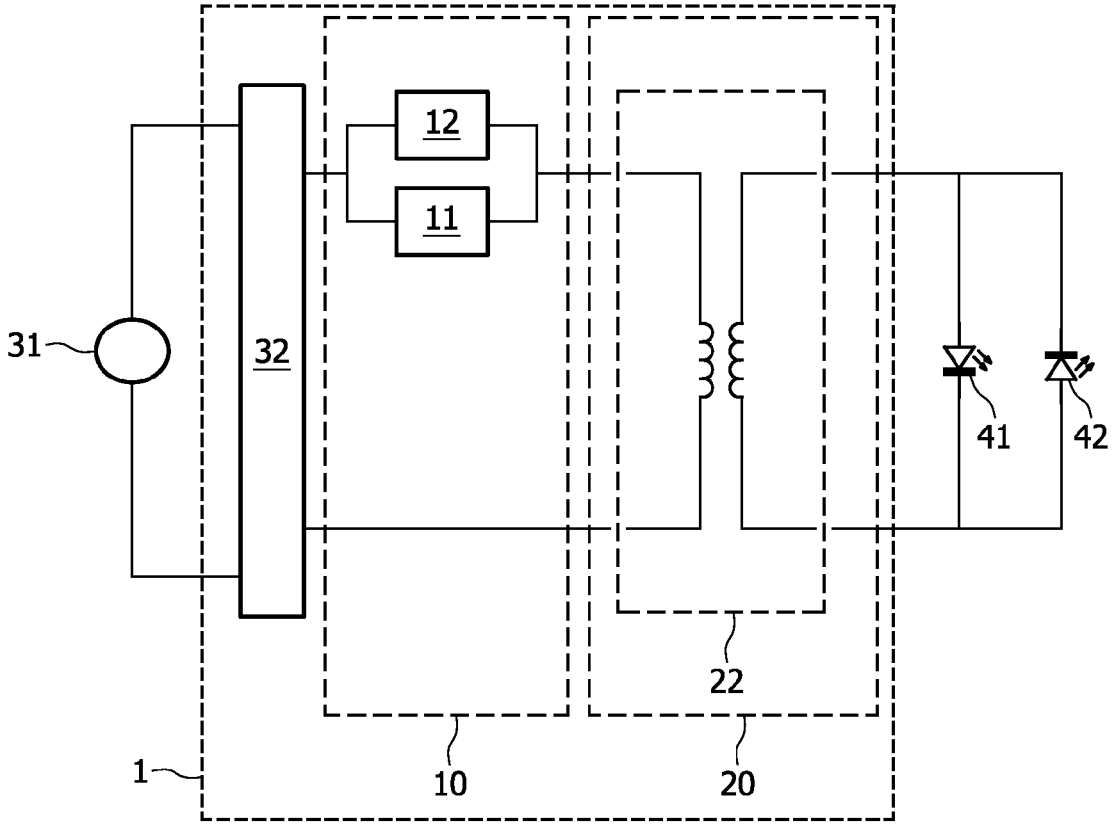
FIG. 3 shows a second embodiment of an apparatus.

FIG. 3 shows a second embodiment of an apparatus 1 comprising an input stage 10 and an output stage 20. The input stage 10 comprises a parallel circuit of an arrangement 11 and a further arrangement 12 coupled to a converter 32. A first input of this converter 32 is coupled to a first terminal of a power source 31 such as a (car) battery, and a second input of this converter 32 is coupled to a second terminal of the power source 31. One side of the parallel circuit is coupled to a first output of the converter 32, and the other side of the parallel circuit is coupled to a first input of transformer circuitry 22 of the output stage 20. A second input of the transformer circuitry 22 is coupled to a second output of the converter 32. A first output of the transformer circuitry 22 is coupled to an anode of a light-emitting diode 41 and a cathode of a light-emitting diode 42, and a second output of the transformer circuitry 22 is coupled to a cathode of the light-emitting diode 41 and an anode of the light-emitting diode 42. The transformer circuitry 22 comprises, for example, one or more coils and/or one or more transformers.

The reactive behavior of the transformer circuitry 22 in particular, and of any kind of circuitry in general, may be used as a part of the resonant tank. For example, the stray inductance of a transformer may be used for realizing a part of the resonant tank.

The apparatus 1 shown in FIG. 3 drives the light-emitting diodes 41 and 42. The output stage 20 supplies a current to the light-emitting diodes 41 and 42. This current has an average value and a peak value. The peak value divided by the average value forms a ratio. The input stage 10 receives a signal from the power supply 31, 32. The power source 31 supplies, for example, a DC voltage, and the converter 32 converts it into, for example, a 100 kHz alternating block signal. The arrangement 11 reduces the ratio by manipulation of the alternating block signal.

The manipulation comprises, for example, an addition of a frequency component to the signal or, for example, an adaptation of an amplitude of a frequency component of the signal. This frequency component of the signal comprises, for example, a third or fifth or seventh harmonic frequency component of a fundamental frequency component of the signal. For an alternating block signal such as a 100 kHz block signal, the fundamental frequency component is thus a 100 kHz component, and the third or fifth or seventh harmonic frequency component is a 300 kHz or 500 kHz or 700 kHz component. The amplitude of the third or fifth or seventh frequency component of the signal divided by an amplitude of the fundamental frequency component of the signal forms a further ratio. This further ratio is, for example, larger than 0% and smaller than 100%, preferably between 5% and 50%, more preferably between 10% and 40%.

If the power supply 31, 32 is a source for supplying a 100 kHz signal with a block shape, the resonant tank of the arrangement 11 is to be tuned to the third (300 kHz) or fifth (500 kHz) or seventh (700 kHz) harmonic frequency component of this 100 kHz block signal. In this case, the further arrangement 12 may comprise, for example, another resonant tank similar to the one of the arrangement 11 but tuned to the fundamental frequency component (100 kHz). The further ratio will depend on the dimensions of the components of the arrangements 11 and 12.

In this way, it has become possible to reduce the ratio by manipulation of the signal. A reduction of the ratio is realized, for example, by a reduction of the peak value while keeping the average value substantially constant. As a result, the light-emitting diode is driven with improved efficiency. In addition, the efficiency of one or more other parts of the input stage and/or the output stage is improved as well, while no smoothing/DC storage capacitors and no smoothing/DC storage inductors are used.

In FIG. 1, connection circuitry instead of the rectifier circuitry 21 may be used, for example, when the light-emitting diodes are placed in an anti-parallel configuration as shown in FIG. 3. In FIG. 1, transformer circuitry may be introduced in addition to the rectifier circuitry 21. In FIG. 3, connection circuitry instead of the transformer circuitry 22 may be used. In FIG. 3, rectifier circuitry may need to be added, for example, when there is only one light-emitting diode or when there is a serial and/or parallel string of light-emitting diodes in a uni-directional connection, etc.

If no further transformer is used in the apparatus 1, a transformer may be present between the power source 30 or 31 and the input stage 10. If a transformer is already used at another location in the apparatus 1, a further transformer may be present between the power source 30 or 31 and the input stage 10. The input stage 10 is a first stage which, in a minimal situation, comprises an arrangement 11 for manipulating a signal from a power supply so as to reduce a peak to average ratio of a current to be supplied to a light-emitting diode, and the output stage 20 is a second stage which, in a minimal situation, comprises wirings for supplying said current to said light-emitting diode. Further stages, such as an intermediate stage, are not to be excluded.

Figure 4:
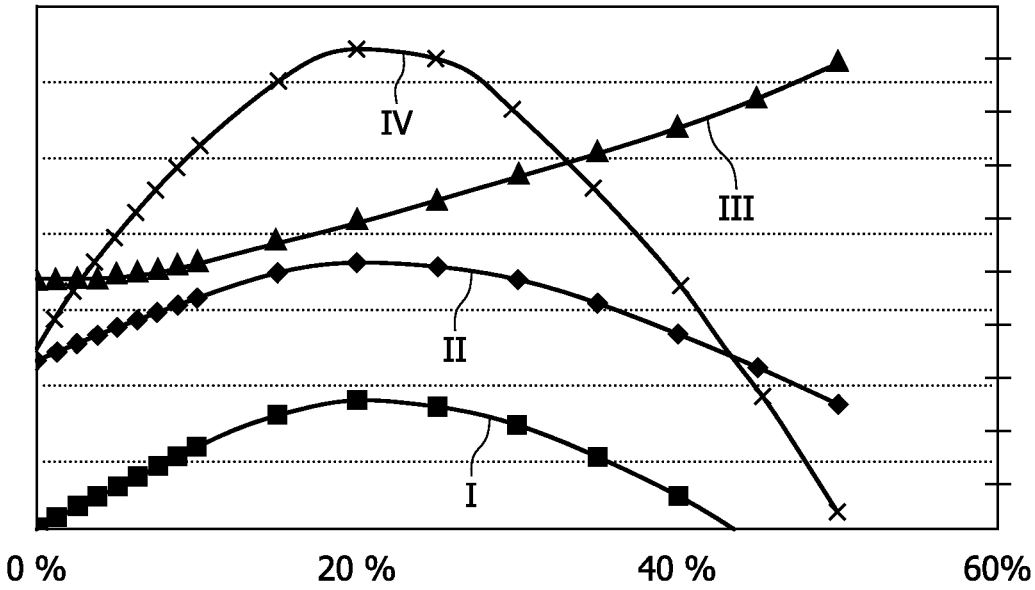
FIG. 4 shows the influence of a third harmonic.

FIG. 4 shows the influence of a third harmonic for (I) the efficiency (lm/W) of the system, (II) the efficiency (lm/W) of the light-emitting diode, (III) the total flux (/lm) generated by the light-emitting diode or diodes and (IV) the driver efficiency, all as a function of a ratio percentage (=the further ratio) formed by an amplitude of a 150 Hz component divided by an amplitude of a 50 Hz fundamental frequency component of a current supplied by the output stage, for a particular type of light-emitting diode. For this particular type of light-emitting diode, there is clearly an optimal value around 20%.

Also for this particular type of light-emitting diode, a ratio defined by a peak value of a current supplied by the output stage divided by an average value of this current can be easily reduced by about 13%, and a ratio defined by a root mean square value of a current supplied by the output stage divided by an average value of this current can be easily reduced by about 5%. The same holds for a current flowing through each light-emitting diode and for a current supplied by the power supply. This is of special interest in combination with the circuitry shown in FIG. 3. Here, a converter operating as a resonant converter is used. This results, for example, in the output current of the converter being substantially zero when the switches in the converter have to switch. This reduces the switching losses. This unloading of the switches is still present in the proposed circuitry. The converter is still operational in the efficient resonant mode and, moreover, the peak value of the output current of the converter is reduced, resulting in an even better efficiency of the converter.

In summary, an input stage 10 of an apparatus 1 for driving a light-emitting diode 40-42 receives a signal from a power supply 30-32, and an output stage 20 supplies a current to the light-emitting diode 40-42. The peak value divided by the average value of the current forms a ratio. The driving efficiency is improved by providing the input stage 10 with an arrangement 11 for reducing this ratio by manipulation of the signal, without the necessity of using any smoothing capacitors/inductors. The manipulation may comprise an addition of a frequency component to the signal or an adaptation of an amplitude of a frequency component of the signal. This frequency component may be a third and/or fifth and/or seventh harmonic frequency component of a fundamental frequency component of the signal. The arrangement 11 may comprise a resonant tank which may need to be tuned to the frequency component of the signal.

While the invention has been illustrated and described in detail in the drawings and foregoing description, these drawings and the description are to be considered illustrative or as examples and are not limiting; the invention is not limited to the disclosed embodiments. For example, the invention can be carried into effect in an embodiment wherein different parts of the different disclosed embodiments are combined to a new embodiment.

Other variations of the disclosed embodiments can be understood and effected by those skilled in the art in practicing the claimed invention, from a study of the drawings, the disclosure, and the appended claims. In the claims, use of the verb "comprise" and its conjugations does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored/distributed on a suitable medium such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. An apparatus for driving a light-emitting diode, the apparatus comprising:

an output stage for supplying a current to the light-emitting diode, the current having an average value and a peak value, the peak value divided by the average value forming a ratio, and an input stage for receiving a signal from a power supply, the input stage comprising an arrangement comprising a resonant tank for reducing the ratio by addition of a frequency component to the signal or an adaption of an amplitude of a frequency component of the signal such that the efficiency of the light-emitting diode is improved.

2. The apparatus of claim 1, wherein the input and output stages include no smoothing capacitors and no smoothing inductors.

3. The apparatus of claim 1, wherein the frequency component of the signal comprises at least one of a fifth and a seventh harmonic frequency component of a fundamental frequency component of the signal.

4. The apparatus of claim 3, wherein an amplitude of the at least one of the fifth and seventh harmonic frequency component of the signal divided by an amplitude of the fundamental frequency component of the signal forms a further ratio which is larger than 5% and smaller than 50%.

5. The apparatus of claim 1, wherein the frequency component of the signal comprises at least one of a third, a fifth and a seventh harmonic frequency component of a fundamental frequency component of the signal, and wherein an amplitude of the at least one of the third, fifth and seventh harmonic frequency component of the signal divided by an amplitude of the fundamental frequency component of the signal forms a further ratio of 20%.

6. The apparatus of claim 1, wherein the output stage comprises at least one of connection circuitry, transformer circuitry, and rectifier circuitry.

7. The apparatus of claim 6, wherein the arrangement comprises a resonant tank which uses reactive properties of the at least one of connection circuitry, transformer circuitry, and rectifier circuitry.

8. The apparatus of claim 1, further comprising a resonant mode converter coupled to a power source of the power supply for generating the signal, wherein one or more phase angles of one or more frequency components of the signal are arranged to keep the converter in a resonant mode.

9. The apparatus of claim 1, wherein the resonant tank circuit is a first series resonant tank circuit connected in a series with the power supply and the output stage.

10. The apparatus of claim 9, wherein the signal has a component at a fundamental frequency, and wherein the first series resonant tank circuit has a resonant frequency at one of a fifth harmonic frequency and a seventh harmonic frequency of the fundamental frequency.

11. The apparatus of claim 9, further comprising a second series resonant tank circuit connected in parallel with the first series resonant tank circuit, wherein the signal has a component at a fundamental frequency, wherein the first series resonant tank circuit has a resonant frequency at a third harmonic frequency of the fundamental frequency, and wherein the second series resonant tank circuit has a resonant frequency at the fundamental frequency.

12. The apparatus of claim 1, wherein the signal has a component at a fundamental frequency and a component at a third harmonic of the fundamental frequency, and wherein the arrangement comprising the resonant tank is configured to attenuate the component at the fundamental frequency more than it attenuates the component at the third harmonic of the fundamental frequency.

13. The apparatus of claim 1, wherein the output stage comprises a rectifier.

14. The apparatus of claim 1, wherein the output stage comprises a rectifier.

15. The apparatus of claim 1, wherein the frequency component of the signal comprises at least one of a third, a fifth, and a seventh harmonic frequency component of a fundamental frequency component of the signal.

16. A method of driving a light-emitting diode, the method comprising:

at an output stage, supplying a current to the light-emitting diode, the current having an average value and a peak value, the peak value divided by the average value forming a ratio, at an input stage, receiving a signal from a power supply, and adding a frequency component to the signal or adapting an amplitude of a frequency component by means of an arrangement comprising a resonant tank for reducing the ratio such that the efficiency of the light-emitting diode is improved.

17. The method of claim 16, wherein the signal has a component at a fundamental frequency and a component at one of a fifth harmonic and a seventh harmonic of the fundamental frequency, and wherein adding the frequency component to the signal or adapting the amplitude of the frequency component by means of the arrangement comprising the resonant tank comprises reducing a magnitude of the component at the fundamental frequency with respect to a magnitude of the component at the one of the fifth harmonic and the seventh harmonic of the fundamental frequency.

18. The method of claim 16, wherein the signal has a component at a fundamental frequency and a component at a third harmonic of the fundamental frequency, and wherein adding the frequency component to the signal or adapting the amplitude of the frequency component by means of the arrangement comprising the resonant tank comprises causing a further ratio of an amplitude of the component at the third harmonic frequency component divided by an amplitude of the fundamental frequency component to be 20%.

19. The method of claim 16, wherein supplying a current to the light-emitting diode includes rectifying the signal to which the frequency component has been added by the input stage.

20. The method of claim 16, wherein the signal has a component at a fundamental frequency, wherein the resonant tank comprises a first series resonant tank circuit, wherein the input stage further includes a second series resonant tank circuit connected in parallel with the first series resonant tank circuit, wherein the first series resonant tank circuit has a resonant frequency at a third harmonic frequency of the fundamental frequency, and wherein the second series resonant tank circuit has a resonant frequency at the fundamental frequency.

* * * * *